US006006970A

United States Patent [19]

Piatt

[11] Patent Number: 6,006,970

[45] Date of Patent: Dec. 28, 1999

[54] COMPUTER HARNESS TO SUPPORT A COMPUTER ABOUT THE BODY OF A USER OPERATOR

[76] Inventor: John Allen Piatt, 226 Getchell St., Santa Cruz, Calif. 95060

[21] Appl. No.: 09/140,357

[22] Filed: Aug. 26, 1998

[51] Int. Cl.[6] ..... A45F 3/14

[52] U.S. Cl. ..... 224/257; 224/258; 224/259; 224/260; 224/262; 224/270; 224/930

[58] Field of Search ..... 224/270, 260, 224/262, 257, 258, 259, 265, 266, 607, 579, 580, 627, 647, 930, 908, 910

[56] References Cited

U.S. PATENT DOCUMENTS

| | | | |
|---|---|---|---|
| 4,168,022 | 9/1979 | Brewer | 224/257 |
| 4,320,863 | 3/1982 | Lyer et al. | 224/259 |
| 5,186,375 | 2/1993 | Plonk | 224/202 |
| 5,205,450 | 4/1993 | Derosier | 224/161 |
| 5,207,791 | 5/1993 | Scherbarth | 273/148 B |
| 5,221,032 | 6/1993 | Bott et al. | 224/270 |
| 5,346,111 | 9/1994 | Huntley et al. | 224/265 |
| 5,667,114 | 9/1997 | Bourque | 224/270 |
| 5,724,225 | 3/1998 | Hrusoff et al. | 361/683 |

*Primary Examiner*—Gregory M. Vidovich
*Assistant Examiner*—Maerena W. Brevaro
*Attorney, Agent, or Firm*—Thomas E. Schatzel; Law Offices of Thomas E. Schatzel A Professional Corp.

[57] ABSTRACT

A laptop computer harness having a left shoulder strap for providing for the support in front of a standing user of a left side of a laptop computer. An upper part of a single belt is attached at a point near a left rear corner of the laptop computer, then passes over the left shoulder and then under the left arm of the user, and with an attachment to attach a lower part of the strap to a left front corner of the laptop computer. A right shoulder strap for providing for the support in front of the user of a right side of the laptop computer. An upper part of a single belt is attached at a point near a right rear corner of the laptop computer, then passes over the right shoulder and then under the right arm of the user, and with an attachment to attach a lower part of the strap to a right front corner of the laptop computer. A chest webbing for gathering the left shoulder strap to the right shoulder strap along a transverse line in front of the user's neck near the user's chest area. A back webbing for gathering the left shoulder strap to the right shoulder strap along a transverse line in back of the user's neck near the user's shoulder-blade area. A rear clamp assembly for mechanically securing the upper parts of the left and right shoulder straps to the left-rear and right-rear corners of the laptop computer. A front clamp assembly for mechanically securing the lower parts of the left and right shoulder straps to the left-front and right-front corners of the laptop computer. A tensioner for drawing the laptop computer taunt between the front and rear clamp assemblies.

12 Claims, 3 Drawing Sheets

120
110
118
134
114
112
134
116
130
134
134
132
124
125
126
122
128

COMPUTER HARNESS TO SUPPORT A COMPUTER ABOUT THE BODY OF A USER OPERATOR

BACKGROUND OF THE INVENTION

1. Field of the Invention

The invention relates generally to laptop computers and more specifically to harnesses and accessories that allow a computer to be mounted about the body of a user operator and for the user operator to comfortably operate the keyboard and view the display screen while standing or in motion away from a desk.

2. Description of the Prior Art

James B. Huntley, et al., describe a "Portable, Personal Computer, Personal Communicator Holder", in U.S. Pat. No. 5,346,111, issued Sep. 13, 1994. A rigid wire frame is worn over the neck of user and is held tight by a back strap that passes behind the neck and under the arms. A rigid wire frame cellular phone holder is attached at the shoulder to hold a phone in a position for use. A tripod of three straps support a suspended personal computer from a horizontal line near the throat of the user.

A "Laptop Computer Carrying Tray" is described by John Hrusoff, et al., in U.S. Pat. No. 5,724,225, issued Mar. 3, 1998. The inventors describe their inventions as a supporting device for a laptop-type personal computer. The device allows the operator to freely stand, sit, walk, carry, or move about with the computer unit intact when in an upright position "with little or no stress". An over-the-shoulder or over-the-neck strap is used to horizontally support a computer carrying tray in front of a user's body. A laptop computer, or anything else really, is placed in the tray for use. A single strap that slings around the back at the upper shoulders is described and this strap attaches to the tray at each side. Adjustments in the way the strap attaches to the tray are provided to tilt the tray for a comfortable angle.

A similar holder is also described by Byron J. Plonk, in U.S. Pat. No. 5,186,375, issued Feb. 16, 1993. A combination holder and writing surface is suspended from a neck sling attached to two opposite corners. A computer laptop can be installed within and inside a channel.

SUMMARY OF THE PRESENT INVENTION

It is therefore an object of the present invention to provide a harness to support a computer about the body of a user operator and such that the user can operate the keyboard and view the screen comfortably while standing or in motion.

Briefly, a laptop computer harness embodiment of the present invention has a left shoulder strap providing for the support in front of a standing user of a left side of a laptop computer. An upper part of a single belt is attached at a point near a left rear corner of the laptop computer, then passes over the left shoulder of the standing user and then under the left arm, and then a lower part of the strap attaches to a left front corner of the laptop computer. A right shoulder strap provides for the support in front of the standing user of a right side of the laptop computer. An upper part of a single belt is attached at a point near a right rear corner of the laptop computer, then passes over the right shoulder of the standing user and then under the right arm, and then a lower part of the strap attaches to a right front corner of the laptop computer. A chest webbing gathers the left shoulder strap to the right shoulder strap along a transverse line in front of a user's neck near the user's chest area. A back webbing gathers the left shoulder strap to the right shoulder strap along a transverse line in back of a user's neck near the user's shoulder-blade area. A rear clamp assembly is provided for mechanically securing the upper parts of the left and right shoulder straps to the left-rear and right-rear corners of the laptop computer. A front clamp assembly provides for mechanically securing the lower parts of the left and right shoulder straps to the left-front and right-front corners of the laptop computer. A tensioner is used to draw the laptop computer tight between the front and rear clamp assemblies.

An advantage of the present invention is that a harness is provided for the use of a laptop computer while standing or sitting.

These and many other objects and advantages of the present invention will no doubt become obvious to those of ordinary skill in the art after having read the following detailed description of the preferred embodiments which are illustrated in the various drawing figures.

IN THE DRAWINGS

DETAILED DESCRIPTION OF THE PREFERRED EMBODIMENTS

Figure 1:
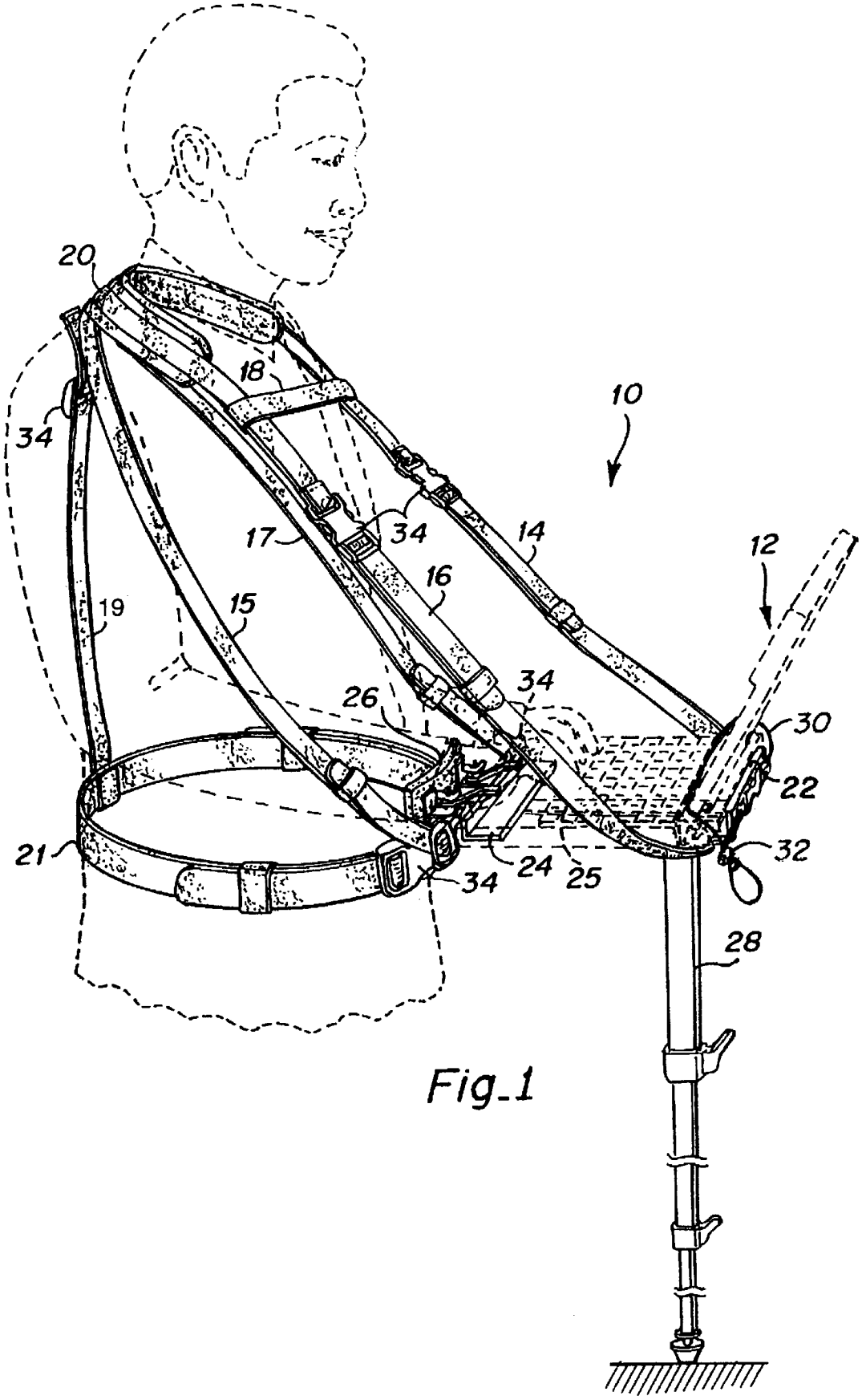
FIG. 1 is a perspective diagram of a laptop computer harness embodiment of the present invention.
Figure 2:
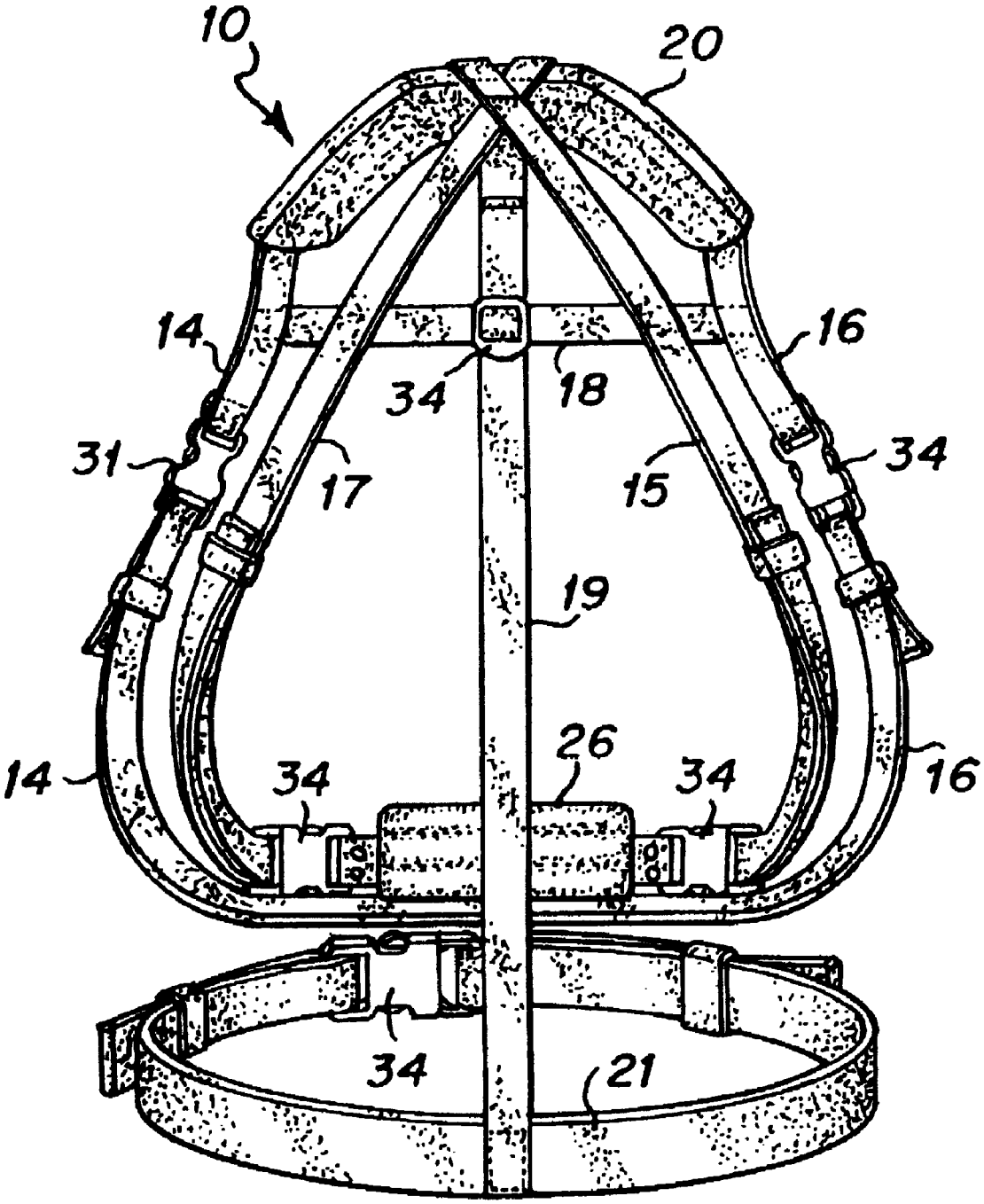
FIG. 2 is a rear perspective view of the laptop computer harness of FIG. 1 without the monopod or security cord.

FIG. 1 illustrates a user-operator wearing a laptop computer harness embodiment of the present invention, referred to herein by the general reference numeral 10. FIG. 2 illustrates the harness 10 from the back. The laptop computer harness 10 is used to support a laptop computer 12 at a convenient position for use in front of the user. The harness 10 comprises a left-front shoulder strap 14 that provides for the support of a left side of the laptop computer 12. A part of a single webbed-nylon belt, for example, is attached at a point near a left rear corner of the laptop computer. Strap 14 then passes over the left shoulder of the user and carries on under the right arm of the user as a right back strap 15. A right-front shoulder strap 16 provides for support of the right side of the laptop computer 12. A part of strap 16 is attached at a point near a right rear corner of the laptop computer, and then carries on over the right shoulder of the user and then under the left arm as a left back strap 17. A chest webbing 18 gathers the left-front shoulder strap 14 to the right-front shoulder strap 16 along a transverse line in front of the user's neck near the user's chest area. A back webbing 19 connects a neck pad 20 to a belt 21. A rear-clamp assembly 22 mechanically secures the left and right front shoulder straps 14 and 16 to the left-rear and right-rear corners of the laptop computer 12. Holes or other cutouts may be provided in the rear-clamp assembly 22 to accommodate the routing of power and data cables that typically connect to the back of the computer.

Similarly, a front clamp assembly 24 mechanically secures the left and right back straps 17 and 15 to the left-front and right-front corners. Such front clamp assembly 24 should provide enough clearance to accommodate any track-pad clicker buttons that protrude from the computer. A tensioner 25 is used to draw the laptop computer 12 tight between the front and rear clamp assemblies 22 and 24. Short legs can be included in the front and rear clamp assemblies 22 and 24 to allow for leveling when placed on a tabletop.

A padded abdominal stand-off 26 is attached to the front clamp assembly 24 and provides for a horizontal outward offset of the laptop computer 12 away from the body of the user by pushing it away at the abdominal area of the user. Such padded abdominal stand-off 26 is preferably made adjustable so that the user can vary the distance the computer keyboard is offset out from the abdomen.

A footing 28 can be attached to the rear clamp assembly 22. Preferably, the footing 28 is a telescoping assembly like that commonly used on the legs of camera tripods, and can be quickly and easily attached and detached. It can be extended to the ground, for example, for rest support of the laptop computer such that the weight of the laptop computer can be occasionally off-loaded from the upper parts of the left and right shoulder straps. A security cord lanyard 30 provides for the lashing of the laptop computer to the rear clamp assembly 22. Security cord 30 acts as a safety lanyard in the event that the laptop slips loose from between the front and rear clamp assemblies. A snap buckle and slip-noose 32 are used to tighten the security cord lanyard 30 around the hinge area of the laptop computer 12 and to allow a quick disconnect. A number of snap buckles 34 are used to allow the user to quickly disconnect the shoulder straps 14 and 16 from the front and rear clamp assembles 22 and 24. The loose ends can thereafter be connected to each opposite side to keep each respective sub-assembly neat.

Figure 3:
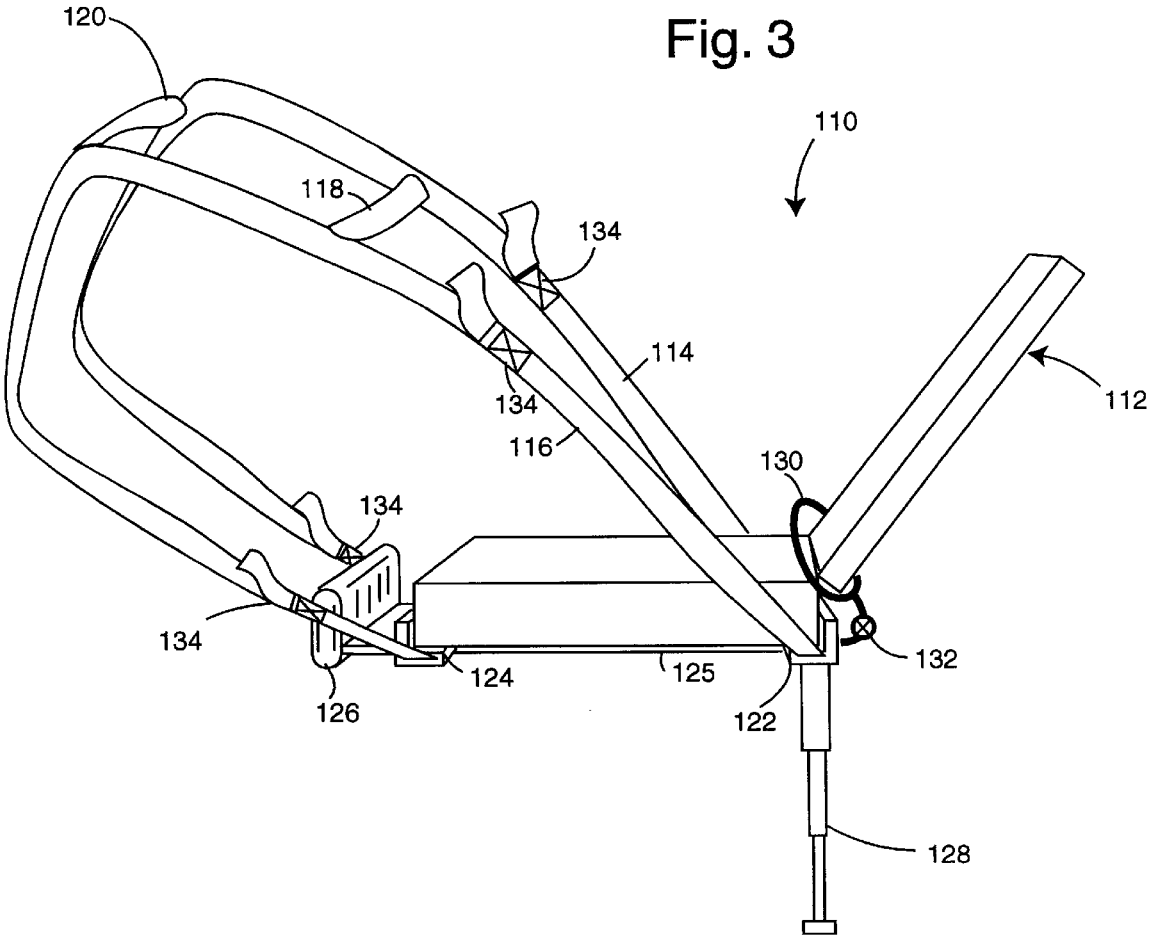
FIG. 3 is a perspective diagram of an alternative embodiment of a laptop computer harness embodiment of the present invention.

FIG. 3 illustrates another embodiment of a laptop computer harness of the present invention, referred to herein by the general reference numeral 110. The harness 110 differs from harness 10 of FIGS. 1 and 2 in the way the straps are arranged and in the way the area in back of the user's neck is constructed. FIG. 3 is intended to show how embodiments of the present invention can vary and yet still stay within the scope of the claimed subject matter. The laptop computer harness 110 is used to support a laptop computer 112 horizontally in front of the user. The harness 110 comprises a left shoulder strap 114 that provides for the support of a left side of the laptop computer 112. An upper part of a single webbed-nylon belt, for example, is attached at a point near a left rear corner of the laptop computer. Strap 114 then passes over the left shoulder of the user and then under the left arm. A lower part of the strap 114 attaches to a left front corner of the laptop computer 112. A right shoulder strap 116 provides for support of the right side of the laptop computer. An upper part of a single belt is attached at a point near a right rear corner of the laptop computer 112, and then passes over the right shoulder of the user and then under the right arm. A lower part of the strap 116 attaches to a right front corner of the laptop computer 112. An adjustable chest webbing 118 gathers the left shoulder strap 114 to the right shoulder strap 116 along a transverse line in front of a user's neck near the user's chest area. An adjustable back webbing 120 gathers the left shoulder strap 114 to the right shoulder strap 116 along a transverse line in back of the user's neck near the user's shoulder-blade area. Such webbings 118 and 120 are typically made adjustable to suit a variety of users.

Two clamps are used to secure the laptop computer between them. Such clamps must clamp the laptop computer securely, but not so tightly that the clamping causes damage or deformation. A rear clamp assembly 122 mechanically secures the upper parts of the left and right shoulder straps 114 and 116 to the left-rear and right-rear corners of the laptop computer 112. Similarly, a front clamp assembly 124 mechanically secures the lower parts of the left and right shoulder straps 114 and 116 to the left-front and right-front corners. A tensioner 125 is used to draw the laptop computer 112 tight between the front and rear clamp assemblies 122 and 124. An abdominal stand-off 126 is attached to the front clamp assembly 124 and provides for a horizontal outward offset of the laptop computer 112 away from the body of the user by pushing it away at the abdominal area of the user.

The arrangement of the clamp assemblies 122 and 124, tensioner 125, and abdominal stand-off 126 are such that the usual connectors and cords are clearly visible and accessible on the laptop computer 112. The arrangement also provides stand-off distance and tilt adjustments so that a user can be comfortable while operating the laptop computer 112. A wide variety of mechanical techniques that can accomplish such goals are well-known to artisans and so will not be detailed here further.

A footing 128 is attached to the rear clamp assembly 122. The footing 128 is a telescoping assembly like that commonly used on the legs of camera tripods. It can be extended to the ground, for example, for rest support of the laptop computer such that the weight of the laptop computer can be occasionally off loaded from the upper parts of the left and right shoulder straps. The footing 128 provides for quick and easy use, because whether the footing 128 is needed can change many times during a single use. A security cord 130 provides for the lashing of the laptop computer to the rear clamp assembly 122. Security cord 130 acts as a safety lanyard in the event that the laptop slips loose from between the front and rear clamp assemblies. A snap buckle and slip noose 132 are used to tighten the lanyard 130 around the hinge area of the laptop computer 112 and to allow a quick disconnect. A set of snap buckles 134 include strap adjustments and also allow the user to completely disconnect the shoulder straps 114 and 116 from the front and rear clamp assembles 122 and 124. Each disconnected end can then be snapped closed to the opposite side to avoid having loose ends.

Although the present invention has been described in terms of the presently preferred embodiments, it is to be understood that the disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

What is claimed is:

1. A harness to support a computer to a user-operator, comprising:

a first shoulder strap for providing support in front of a user operator of a first side of a laptop computer including a first single belt for attachment at a point near a first rear corner of the laptop computer and extending over the first shoulder and then under an arm of the user and then for attachment to a front corner of the laptop computer;

a second shoulder strap for providing support in front of the user operator of a second side of the laptop computer including a second single belt for attachment at a point near a second rear corner of the laptop computer and extending over the second shoulder of the user and then under an arm of the user and then for attachment to another front corner of the laptop computer;

a chest webbing for gathering the first shoulder strap to the second shoulder strap along a transverse line in front of the user's neck near said user's chest area;

a back webbing for gathering the first shoulder strap to the second shoulder strap along a transverse line in back of the user's neck near said user's shoulder-blade area;

a rear clamp assembly for mechanically securing the upper parts of the first and second shoulder straps to the rear corners of the laptop computer;

a front clamp assembly for mechanically securing the lower parts of the first and second shoulder straps to the front corners of said laptop computer; and a tensioner for drawing the laptop computer taunt between the front and rear clamp assemblies.

2. The harness of claim 1, further comprising:

an abdominal stand-off attached to the front clamp assembly for providing a horizontal outward offset of the laptop computer away from the user's body by projecting away from the user's abdominal area.

3. The harness of claim 1, further comprising:

a security cord for lashing the laptop computer to the rear clamp assembly and providing a safety lanyard in the event that the laptop computer releases from between the front and rear clamp assemblies.

4. The harness of claim 1, further comprising:

a footing attached to the rear clamp assembly providing rest support of the laptop computer such that the weight of the laptop computer can be occasionally off loaded from said upper parts of the first and second shoulder straps while being mounted about the user's shoulders.

5. The harness of claim 2, further comprising:

a security cord for lashing the laptop computer to the rear clamp assembly and providing a safety lanyard in the event that the laptop computer releases from between the front and rear clamp assemblies.

6. The harness of claim 3, further comprising:

a footing attached to the rear clamp assembly providing rest support of the laptop computer such that the weight of the laptop computer can be occasionally off loaded from said upper parts of the first and second shoulder straps while being mounted about the user's shoulders.

7. The harness of claim 2, further comprising:

a security cord for lashing the laptop computer to the rear clamp assembly and providing a safety lanyard in the event that the laptop computer releases from between the front and rear clamp assemblies; and a footing attached to the rear clamp assembly providing rest support of the laptop computer such that the weight of the laptop computer can be occasionally off loaded from said upper parts of the first and second shoulder straps while being mounted about the user's shoulders.

8. A harness to support a computer to a user-operator, comprising:

a clamp assembly with a front and rear clamp drawn together by a tensioning strap for gripping a laptop computer; and a webbing for wearing over the arms, head, and shoulders of a user during operation of the laptop computer and attached to the clamp assembly at each of four outside corners;

wherein, the webbing is attached to the clamp assembly such that the laptop computer is supported for use in front of the user.

9. The harness of claim 8, wherein:

the webbing is such that it includes a pair of lower straps that pass under the arms of the user and attach to a near-end of the clamp assembly.

10. The harness of claim 8, wherein:

the webbing is such that it includes a pair of upper straps that pass over the shoulders of the user and attach to a far-end of the clamp assembly.

11. The harness of claim 8, further comprising:

a security cord for lashing the laptop computer to the clamp assembly and for providing a safety lanyard in the event that the laptop computer releases from between the clamp assembly; and a footing attached to said clamp assembly and providing a rest support for the laptop computer, wherein the weight of the laptop computer can be occasionally off-loaded from the webbing.

12. A personal computer accessory, comprising:

a left shoulder strap for providing support in front of a user operator of a left side of a laptop computer including a first single belt for attachment at a point near a left rear corner of the laptop computer and extending over the left shoulder and then under the left arm of the user and then for attachment to a left front corner of the laptop computer;

a right shoulder strap for providing support in front of the user operator of a right side of said laptop computer including a second single belt for attachment at a point near a right rear corner of the laptop computer and extending over the right shoulder of the user and then under the right arm of the user and then for attachment to a right front corner of the laptop computer;

a chest webbing for gathering the left shoulder strap to the right shoulder strap along a transverse line in front of the user's neck near said user's chest area;

a back webbing for gathering the left shoulder strap to the right shoulder strap along a transverse line in back of the user's neck near said user's shoulder-blade area;

a rear clamp assembly for mechanically securing the upper parts of the left and right shoulder straps to the left-rear and right-rear corners of said laptop computer;

a front clamp assembly for mechanically securing the lower parts of the left and right shoulder straps to the left-front and right-front corners of the laptop computer;

a tensioner for drawing the laptop computer taunt between the front and rear clamp assemblies;

an abdominal stand-off attached to the front clamp assembly for providing a horizontal outward offset of the laptop computer away from the user's body by projecting away from the user's abdominal area;

a security cord for lashing the laptop computer to the rear clamp assembly and providing a safety lanyard in the event that the laptop computer releases from between the front and rear clamp assemblies; and a footing attachable to the rear clamp assembly and providing occasional rest support of the laptop computer, and such that the weight of the laptop computer can be periodically off loaded from the left and right shoulder straps.

* * * * *